United States Patent [19]

Felstet

[11] Patent Number: 4,550,512

[45] Date of Patent: Nov. 5, 1985

[54] EXCAVATOR BUCKET WITH DETACHABLE IMPLEMENTS

[76] Inventor: Rickerd M. Felstet, P.O. Box 341, East Helena, Mont. 59635

[21] Appl. No.: 641,654

[22] Filed: Aug. 17, 1984

[51] Int. Cl.[4] ..... E02F 3/76

[52] U.S. Cl. ..... 37/117.5; 37/DIG. 3; 37/DIG. 12; 172/701.3; 172/753; 414/724; 414/912

[58] Field of Search ..... 37/117.5, DIG. 3, DIG. 12; 414/607, 724, 912; 172/701.3, 753

[56] References Cited

U.S. PATENT DOCUMENTS

| | | | |
|---|---|---|---|
| 3,921,837 | 11/1975 | Vandewater | 37/117.5 X |
| 3,942,271 | 3/1976 | George | 37/117.5 |
| 4,043,060 | 8/1977 | Stepe | 37/117.5 X |
| 4,151,664 | 5/1979 | Maura | 37/117.5 |
| 4,189,854 | 2/1980 | Haynes | 37/117.5 |
| 4,208,814 | 6/1980 | Stone | 37/117.5 |
| 4,278,368 | 7/1981 | Livesay | 37/117.5 X |
| 4,360,980 | 11/1982 | Jarvis | 37/117.5 |
| 4,411,081 | 10/1983 | King | 37/117.5 |
| 4,411,585 | 10/1983 | Quinn | 37/DIG. 3 |

*Primary Examiner*—Edgar S. Burr
*Assistant Examiner*—Moshe I. Cohen
*Attorney, Agent, or Firm*—Dowell & Dowell

[57] ABSTRACT

An excavator bucket has a ground engaging portion with a central housing and side housings providing sockets for receiving the tangs of various implements for use in the excavation and grading of earth. The structure and arrangement of the housings provide a secure mounting for the various implements and also permits a ready attachment and detachment from the bucket with a minimum number of connections.

11 Claims, 7 Drawing Figures

EXCAVATOR BUCKET WITH DETACHABLE IMPLEMENTS

BACKGROUND OF THE INVENTION

1. Field of the Invention

This invention relates to excavator buckets of the kind that are commonly used with backhoes, dragline buckets, or shovel dippers which are provided with a working or cutting edge for the purpose of engaging and displacing the earth which may then be picked up in the shell of the bucket.

In equipment of this nature it is essential that the cutting edges of the implements associated with the bucket be securely mounted in order to withstand the stresses which are incurred in their operation and also to permit their ready replacement in the event that the implements are broken, worn, or become dull or otherwise need to be replaced.

Furthermore, a unit may be called upon to perform various kinds of work depending upon the terrain on which it is being used. For example, the common use of a bucket of this type is to break up and scrape the earth and to remove dirt that is picked up in the bucket, such operation normally requiring a series of spaced teeth. Other operations desirably, in addition to a series of spaced teeth, require colters, or teeth at a different angle or elevation with respect to the remaining teeth.

In other uses the bucket may be provided with a straight bar that is used for landscaping or grading rather than for digging earth.

Therefore, it is desirable that a bucket be employed onto which a variety of implements may be mounted with a minimum of effort, which can be easily replaced.

2. Description of the Prior Art

The prior art includes various buckets or excavating implements in which the teeth or portions thereof may be replaced, sometimes as individual tools and sometimes in groups. Examples of patents disclosing equipment of this nature are Clark U.S. Pat. No. 1,540,314; Mulally U.S. Pat. No. 1,757,328; Hahn et al. U.S. Pat. No. 3,685,177; and Klett et al. U.S. Pat. No. 3,864,853. In the above patents the implements appear to be detachable either individually or in groups by means of rivets or other fastening means which extend through the floor or working surface of the bucket, itself, and in which a multiplicity of connecting members is involved, thereby entailing a substantial amount of effort and time for substituting various implements.

The patents to Haynes U.S. Pat. No. 3,436,849, and Bronson et al. U.S. Pat. No. 3,795,070 disclose buckets in which the bottom or teeth members may be adjusted outwardly from the lower bottom of the bucket, in order that various functions may be accomplished due to such adjustment.

SUMMARY OF THE INVENTION

The present invention includes an excavator bucket having a substantially C-shaped bowl with a lower ground engaging portion with a forward edge in which the ground engaging portion has a central housing and socket means at the sides thereof. The various implements each include a bar portion having a rearwardly extending tang which engages the central housing and having side tangs or members which are received in the side sockets. Thus, by merely providing a pair of fastening means at each side of the central housing the various implements may be secured and removed.

In the event an additional cutter member is provided at the center an additional housing is mounted over the bar and spaced above the central tang and is adapted to receive the tang of the additional cutter member which may be attached thereto by a fastening means extending through the housing.

BRIEF DESCRIPTION OF THE DRAWINGS

With further reference to the drawings.

DESCRIPTION OF THE PREFERRED EMBODIMENT

Figure 1:
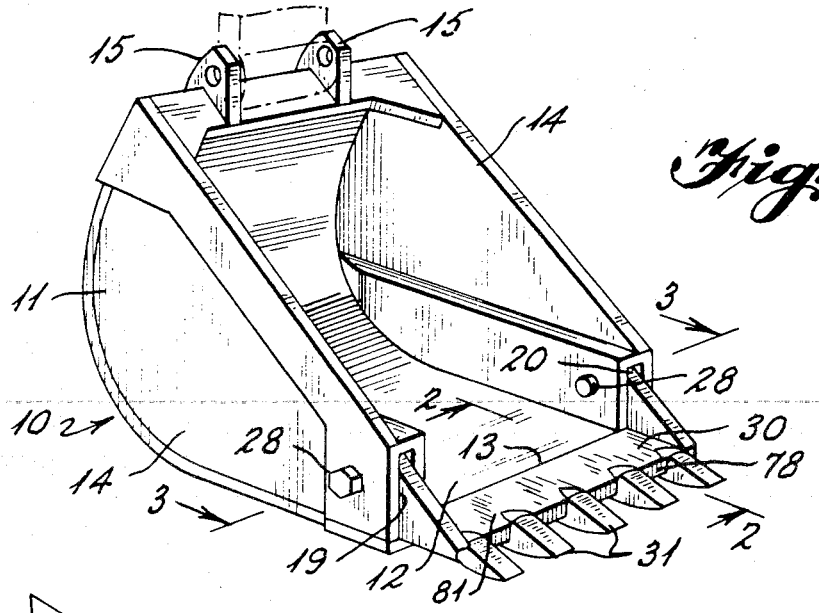
FIG. 1 is perspective of a preferred embodiment of the invention.

With further reference to the drawings, an excavator bucket 10 has a substantially C-shaped bowl 11 forming a substantially flat ground engaging portion 12 with a forward edge 13 and oppositely disposed walls 14 at each side of the bowl. The upper portion of the bowl has lugs 15 for attachment to a device for lifting and operating the bucket.

The ground engaging portion has a central socket means 18 and side socket means 19 and 20. The socket means 18 is formed by upper and lower spaced plates 21 and 22 in the central portion of the ground engaging portion and spacers 23 and 24 therebetween. The socket means 18 extends longitudinally of the ground engaging portion 12. The side socket means 19 and 20 are formed between the spaced side plates 25 and 26 and extend along the sides of the bowl 11. In order to fasten the tangs of an implement thereto the side plates 25 and 26 are provided with openings 27, one of which may be threaded to receive a bolt 28 which extends through the opening in the oppositely disposed wall.

A first selectively attachable earth working implement is illustrated in FIGS. 1–4 and has a bar 30 with spaced teeth 31 mounted thereon so as to extend forwardly of the front wall or earth engaging wall 78. Extending from the rear wall 80 of the bar is a first or central tang 32. Extending from the sides of the bar are second and third tangs 33 and 34, each of which has an opening 35 to receive the fastening means 28 when the device is assembled as illustrated in FIG. 1.

The device is easily assembled by inserting the tangs 32, 33, and 34 into the sockets 18, 19, and 20 respectively after which the bolts are secured.

Figure 2:
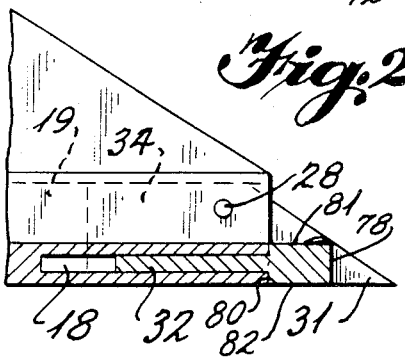
FIGS. 2 and 3 are sections on the lines 2—2 and 3—3, respectively, of FIG. 1.
Figure 3:
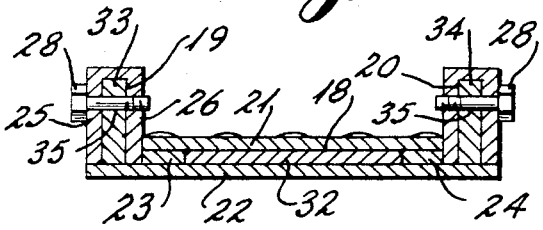
Figure 4:
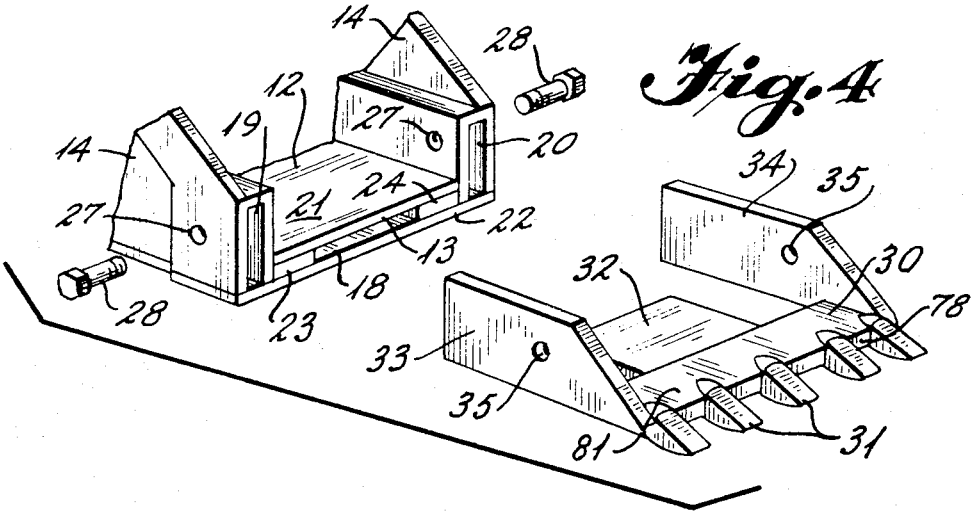
FIG. 4 is an exploded view of the forward edge portion of the bowl and an implement.

With particular reference to FIGS. 2–4 of the drawings, it should be noted that the first or central tang 32 is preferable integrally formed or attached with the bar 30 and is shown as being disposed outwardly between the upper and lowermost surfaces 81 and 82, respectively, of the bar 30. In this manner, when the tang 32 is inserted into the socket 18, the uppermost surface 81 of the earth working bar 30 will be substantially coextensive with the inner surface of the bucket 10. Additionally, the tang 32 may be somewhat horizontally extensive so as to substantially fill the width of the socket 18 as shown in FIG. 3.

With particular reference to FIG. 4, the second and third tangs 33 and 34 are shown as being both longitudinally and vertically oriented so that they are generally perpendicular with respect to the first tang 32. In this manner, the second and third tangs extend upwardly above the upper surface 81 of the bar 30.

Figure 5:
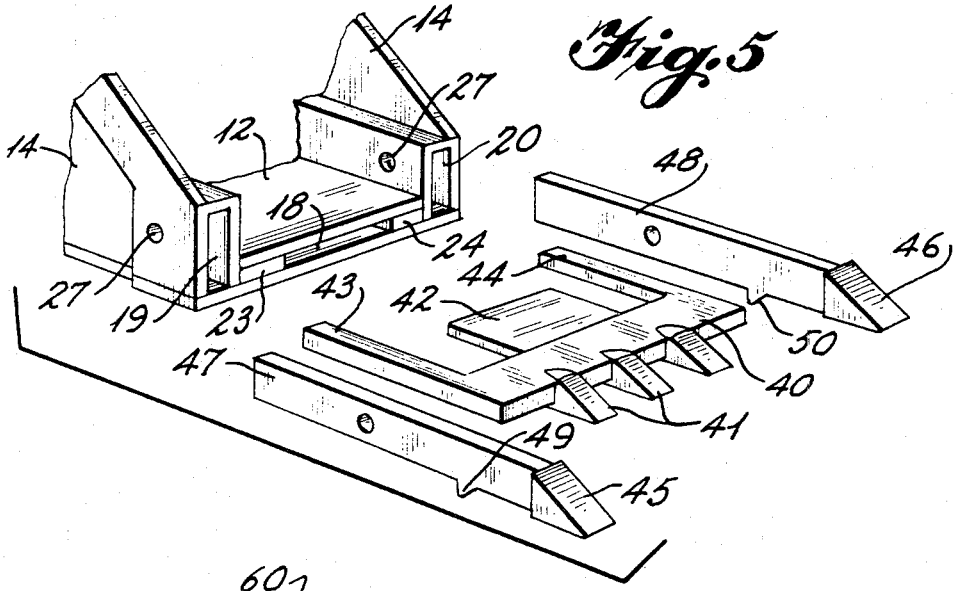
FIG. 5 is an exploded section illustrating a modification.

Instead of employing the earth working implements discussed above, a double side mount ripper or coulter may be employed as illustrated in FIG. 5. The device in FIG. 5 includes a main bar 40 having a series of teeth 41 and a rearwardly extending central tang 42 and rearwardly extending side tangs 43 and 44. Ripper teeth 45 and 46 having shanks 47 and 48 with lugs 49 and 50 are received in the sockets 19 and 20, the lugs engaging the bar 42 to retain it in place.

Figure 6:
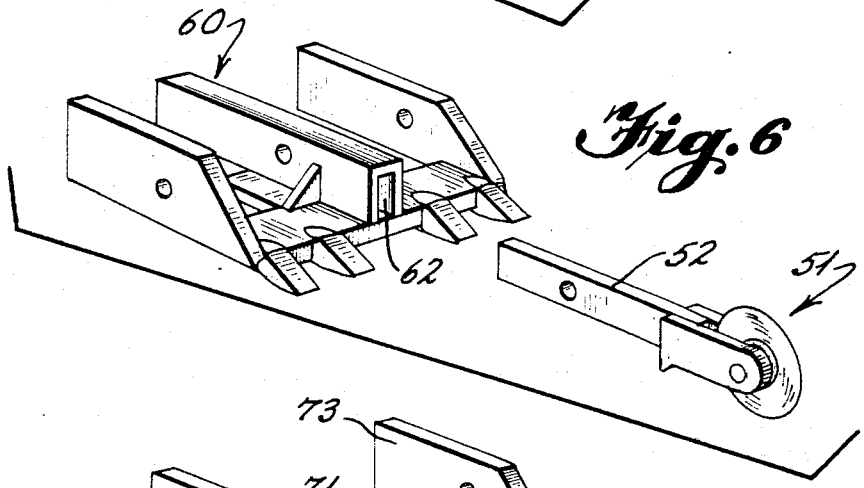
FIG. 6 is an exploded view illustrating a further implement.

Instead of ripper teeth a colter 51 having a shank 52 as indicated in FIG. 6 may be substituted. The ripper teeth or colters are retained by the bolts extending through the openings 26 in the sidewalls of the bucket.

In the modification of FIG. 6 the first bucket front has an additional housing 60 mounted in spaced relation above the central tang 32 and extending parallel thereto. The housing 60 has a socket 62 for receiving the tang 52 of a colter 51.

Figure 7:
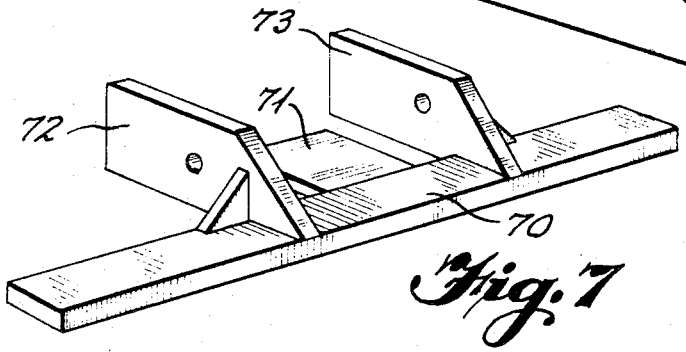
FIG. 7 is a perspective of another type of implement.

In the further modification of FIG. 7 the first bucket front is replaced by a landscape or grading attachment including a bar 70 having a rearwardly extending central tang 71 and side tangs 72 and 73.

I claim:

1. An excavator bucket assembly comprising the combination of a bucket means and earth working implements, said bucket means having a foward lower edge portion, a rear wall and oppositely disposed side walls, said forward lower edge portion having a first socket means therein for selectively receiving and mounting one of said earth working implements therein so as to project from said forward lower edge portion, said first socket means being defined by spaced walls which form at least a portion of said forward lower edge portion, second and third socket means provided adjacent each of said side walls of said bucket means and extending from adjacent said forward lower edge portion toward said rear wall of said bucket means, said earth working implements having earth engaging means supported on a tool bar means, said tool bar means having spaced ends, a first tang means extending rearwardly from said tool bar means and intermediate said ends thereof so as to be selectively receiveable within said first socket means, said earth working implements having second and third tang means which extend rearwardly therefrom on opposite sides of said first tang means so as to be selectively receivable in said second and third socket means, respectively, and fastening means for selectively connecting said tool bar means to said bucket means.

2. The excavator bucket assembly of claim 1 in which said tool bar means includes a rear wall, upper and lower surfaces and a front wall, said front wall defining an earth working edge, said first tang means being disposed outwardly from said rear wall and extending in a plane below the plane defined by said upper surface of said tool bar means so that when said first tang means is selectively mounted within said first socket means said upper surface of said tool bar means will be substantially coextensive with said inner surface of said bucket means and said rear wall of said tool bar means will abut said forward lower edge portion of said bucket means.

3. The excavator bucket assembly of claim 2 in which each of said second and third socket means are defined by spaced wall plates which extend from adjacent said forward lower edge portion of said bucket means toward said rear wall thereof, said second and third tang means being selectively receivable between said spaced wall plates, and means for selectively retaining said second and third tang means within said second and third socket means.

4. The excavator bucket assembly of claim 3 in which said first tang means extends in a plane generally parallel to said tool bar means and each of said second and third tang means extends upwardly in a perpendicular relationship with respect to said tool bar means.

5. The excavator bucket assembly of claim 4 including a plurality of earth engaging teeth mounted to said front wall of said tool bar means.

6. The excavator bucket assembly of claim 4 in which said means for fastening said tool bar means includes first openings through each of said second and third tang means and second openings through said wall plates defining said second and third socket means, and pin means receivable within said first and second openings when said second and third tang means are selectively mounted within said second and third socket means, respectively.

7. The excavator bucket assembly of claim 3 including a rearwardly extending housing mounted on said tool bar means and extending outwardly over said first tang means, a fourth socket means formed within said housing, a secondary earth working tool means having an elongated shank and an earth engaging portion, said elongated shank of said secondary earth working tool means being selectively receivable within said fourth socket means, and means for securing said secondary earth working tool means within said fourth socket means.

8. The excavator bucket assembly of claim 3 including at least one supplemental tool means having an earth working portion and a shank portion, said shank portion of said supplemental tool means being selectively receivable within one of said second and third socket means so as to be in overlying relationship with respect to one of said second and third tang means of said tool bar means and means for securing said shank means of said supplemental tool means with said one of said second and third socket means to thereby retain said secondary tool means and said tool bar means within said second or third socket means.

9. The excavator bucket assembly of claim 8 including lug means formed on said shank means of said supplemental tool means, each of said lug means extending outwardly from said shank means so as to engage said front wall of said tool bar means when said supplemental tool means is inserted within said second or third socket means to thereby prevent the withdrawal of said tool bar means from said second or third socket means.

10. The excavator bucket assembly of claim 9 including first and second supplemental tool means selectively mounted within said second and third socket means, respectively.

11. The excavator bucket assembly of claim 8 in which said tool bar means has upper and lower surfaces, said second and third tang means having upper surfaces which are substantially coplanar with said upper surface of said tool bar means, said first tang means having an upper surface disposed below said upper surface of said tool bar means.

* * * * *